US009409050B2

(12) United States Patent
Mintz

(10) Patent No.: US 9,409,050 B2
(45) Date of Patent: Aug. 9, 2016

(54) COMBINED EXERCISE APPARATUS

(71) Applicant: Hagay Mintz, Kiryat Ata (IL)
(72) Inventor: Hagay Mintz, Kiryat Ata (IL)

( * ) Notice: Subject to any disclaimer, the term of this patent is extended or adjusted under 35 U.S.C. 154(b) by 0 days.
(21) Appl. No.: 14/629,504
(22) Filed: Feb. 24, 2015
(65) Prior Publication Data
US 2015/0238806 A1 Aug. 27, 2015
(30) Foreign Application Priority Data
Feb. 24, 2014 (IL) ..... 231105
(51) Int. Cl.
*A63B 22/02* (2006.01)
*A63B 21/06* (2006.01)
*A63B 21/015* (2006.01)
*A63B 23/035* (2006.01)
*A63B 69/00* (2006.01)
(52) U.S. Cl.
CPC ..... *A63B 22/02* (2013.01); *A63B 21/015* (2013.01); *A63B 21/0615* (2013.01); *A63B 23/0355* (2013.01); *A63B 23/03525* (2013.01); *A63B 23/03541* (2013.01); *A63B 23/03575* (2013.01); *A63B 23/03591* (2013.01); *A63B 2069/0033* (2013.01); *A63B 2225/09* (2013.01); *Y10T 29/49826* (2015.01)
(58) Field of Classification Search
USPC ..... 482/1–148
See application file for complete search history.

(56) References Cited

U.S. PATENT DOCUMENTS 5,679,100 A * 10/1997 Charnitski ..... A63B 22/001 482/37
5,803,874 A * 9/1998 Wilkinson ..... A63B 22/0012 482/51
5,951,449 A 9/1999 Oppriecht
6,450,923 B1 * 9/2002 Vatti ..... A63B 21/00181 482/51
7,775,943 B2 * 8/2010 Vittone ..... A63B 21/0552 482/121
7,785,242 B2 * 8/2010 Solomon ..... A61H 1/0229 482/121
8,007,409 B2 * 8/2011 Ellis ..... A63B 21/0615 482/54
8,147,386 B2 * 4/2012 Farnsworth ..... A63B 23/1209 482/121
8,172,729 B2 * 5/2012 Ellis ..... A63B 21/4047 482/54
8,241,187 B2 8/2012 Moon et al.
8,454,479 B2 * 6/2013 Ellis ..... A63B 21/0615 482/54
2005/0255971 A1 * 11/2005 Solomon ..... A61H 1/0229 482/54
2006/0128532 A1 * 6/2006 Wang ..... A63B 21/0083 482/54
2011/0082011 A1 * 4/2011 Ellis ..... A63B 21/0615 482/54
2011/0118090 A1 * 5/2011 Ellis ..... A63B 21/4047 482/54
2011/0312474 A1 * 12/2011 Ellis ..... A63B 21/0615 482/54
2014/0038792 A1 * 2/2014 Farnsworth ..... A63B 22/0012 482/112
2015/0352396 A1 * 12/2015 Dalebout ..... A63B 22/02 482/54
2016/0001118 A1 * 1/2016 Kuehne ..... A63B 69/0064 482/54

* cited by examiner

*Primary Examiner* — Stephen Crow
(74) *Attorney, Agent, or Firm* — Mark David Torche; Patwrite LLC

(57) ABSTRACT

A treadmill assembly, respective kit-of-parts and method of assembling combined exercise apparatus are described. The treadmill assembly includes a couple of vertical struts, a couple of support tabs including a fastener affixable to the vertical struts, at least one structural element configured to sustain rotation relatively to the support tabs, a couple of add-on members including a driven subpart and a weight loading subpart.

18 Claims, 4 Drawing Sheets

COMBINED EXERCISE APPARATUS

TECHNICAL FIELD

In general, the present invention pertains to the art of machines and methods for exercise. In particular, the invention relates to a modular add-on for a treadmill allowing a Nordic walking exercise as well as forceful strength training and/or weight lifting exercise.

BACKGROUND ART

It is believed that the pertinent state-of-the-art is represented by US patent publications: U.S. Pat. No. 5,000,440, U.S. Pat. No. 5,171,196, US2008287267, U.S. Pat. No. 6,544,147, US2009075784, U.S. Pat. No. 5,632,708, U.S. Pat. No. 8,007,409, U.S. Pat. No. 8,241,187, U.S. Pat. No. 5,951,449 and U.S. Pat. No. 5,110,117; European patent publications: EP1312395 and EP0877640; German utility model DE202005012299 and Chinese utility model CN2511339 as well as by international patent publication WO9938575.

U.S. Pat. No. 5,000,440 that is considered the most relevant prior art discloses an exercising device combining a treadmill with an upper body muscle stressing device. An upright frame is supported from the base of the treadmill according to U.S. Pat. No. 5,000,440. A weight support frame in U.S. Pat. No. 5,000,440 is pivotally attached to the upper end of such frame. Weights are supported from the exercising frame. The exerciser in U.S. Pat. No. 5,000,440 lifts up on the exercising frame while weights exert a downward force. At the same time, the exerciser in U.S. Pat. No. 5,000,440 is using the treadmill to obtain aerobic level exercise.

U.S. Pat. No. 5,171,196 discloses exercising device combining an inclinable treadmill with an upper body exercising assembly having two or more sets of levers with handles. The resistance loading of each set of levers according to U.S. Pat. No. 5,171,196 may be independently controlled and varied. The device of U.S. Pat. No. 5,171,196 combines strength training with aerobic exercise. Computerized controls and monitors are used in U.S. Pat. No. 5,171,196. The device of U.S. Pat. No. 5,171,196 may be used in a weightless environment.

U.S. Pat. No. 8,007,409 discloses an exercise treadmill having an endless exercise surface for walking or running while exercising, a resistance mechanism for providing a resistance for simulating the pushing of a load, wherein the resistance can be adjusted and set to a specific resistance setting. A movable pushing handle or handles is or are operatively attached to the resistance mechanism to transfer the load to the user. The resistance mechanism applies a constant and static force to the pushing handle(s) only in the same direction the endless movable surface moves and opposite a pushing direction such that operating the treadmill simulates the pushing of a load by a combination of gripping and pushing the pushing handle(s) forward while walking or running forward.

U.S. Pat. No. 8,241,187 discloses systems and methods for a treadmill or similar exercise device which utilizes a principally arm driven belt, but includes a motor assist which provides for additional drive to the belt. The motor assist device may constructively or destructively interact with the user provided motive force via the arms. Generally, the motor will allow for the device to utilize incline as well as to make the device easier to start from rest.

U.S. Pat. No. 5,951,449 discloses is an exercise device including a piston disposed within a cylinder having a first open end and a second end having a valve which independently controls air intake and exhaust through the second end of the cylinder, thereby controlling the air pressure exerted on the piston and hence the force required to raise the piston. A flexible connector is attached to the top of the piston, exits through the open end of the cylinder, and passes through a series of pulleys such that force exerted by the user on the opposite end of the connector is transmitted to the piston, whereby the piston slides within the cylinder.

DESCRIPTION OF THE DRAWINGS

The present invention will be understood and appreciated more comprehensively from the following detailed description taken in conjunction with the appended drawings in which.

Figure 1:
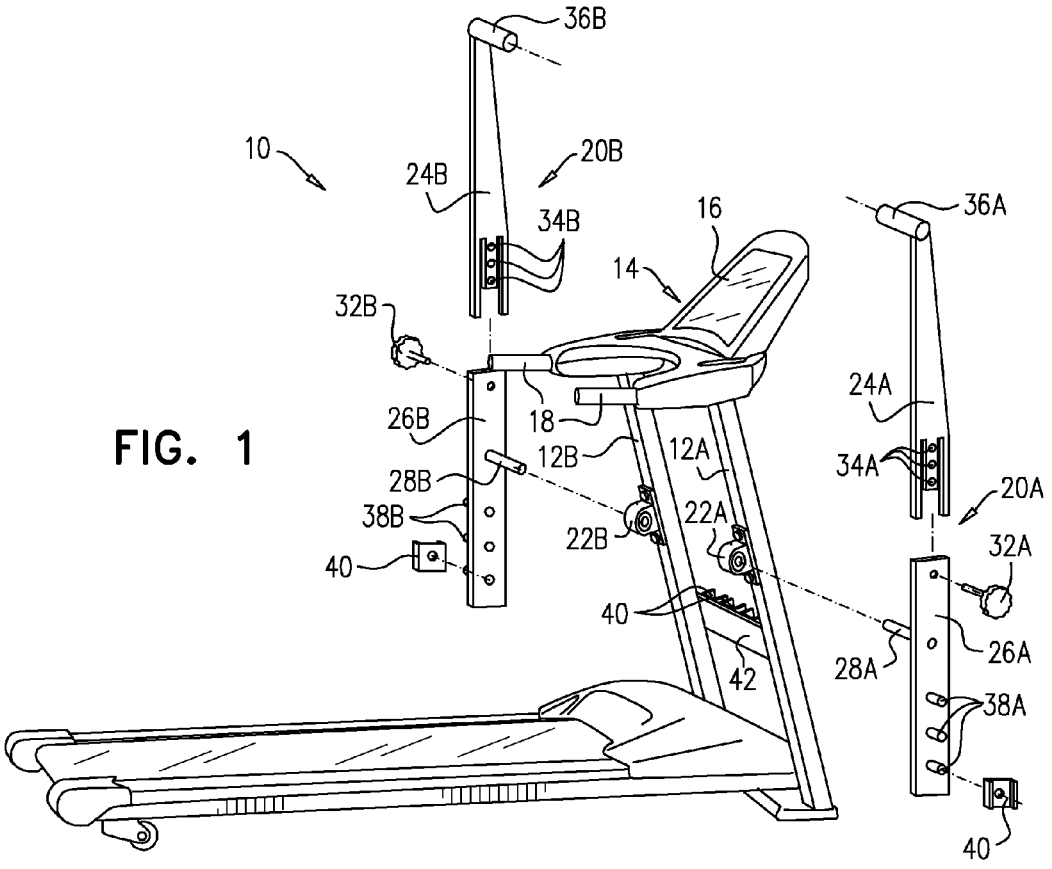
FIG. 1 is an exploded perspective view of an embodiment of a combined exercise apparatus of the invention.
Figure 2:
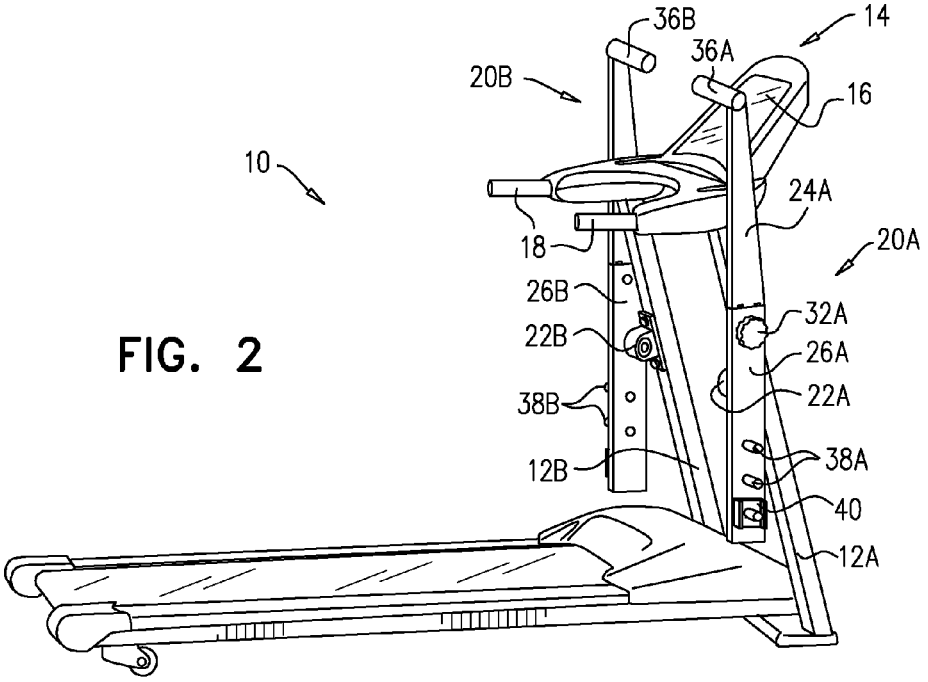
FIG. 2 is a perspective view of an embodiment of the combined exercise apparatus of the invention.
Figure 3:
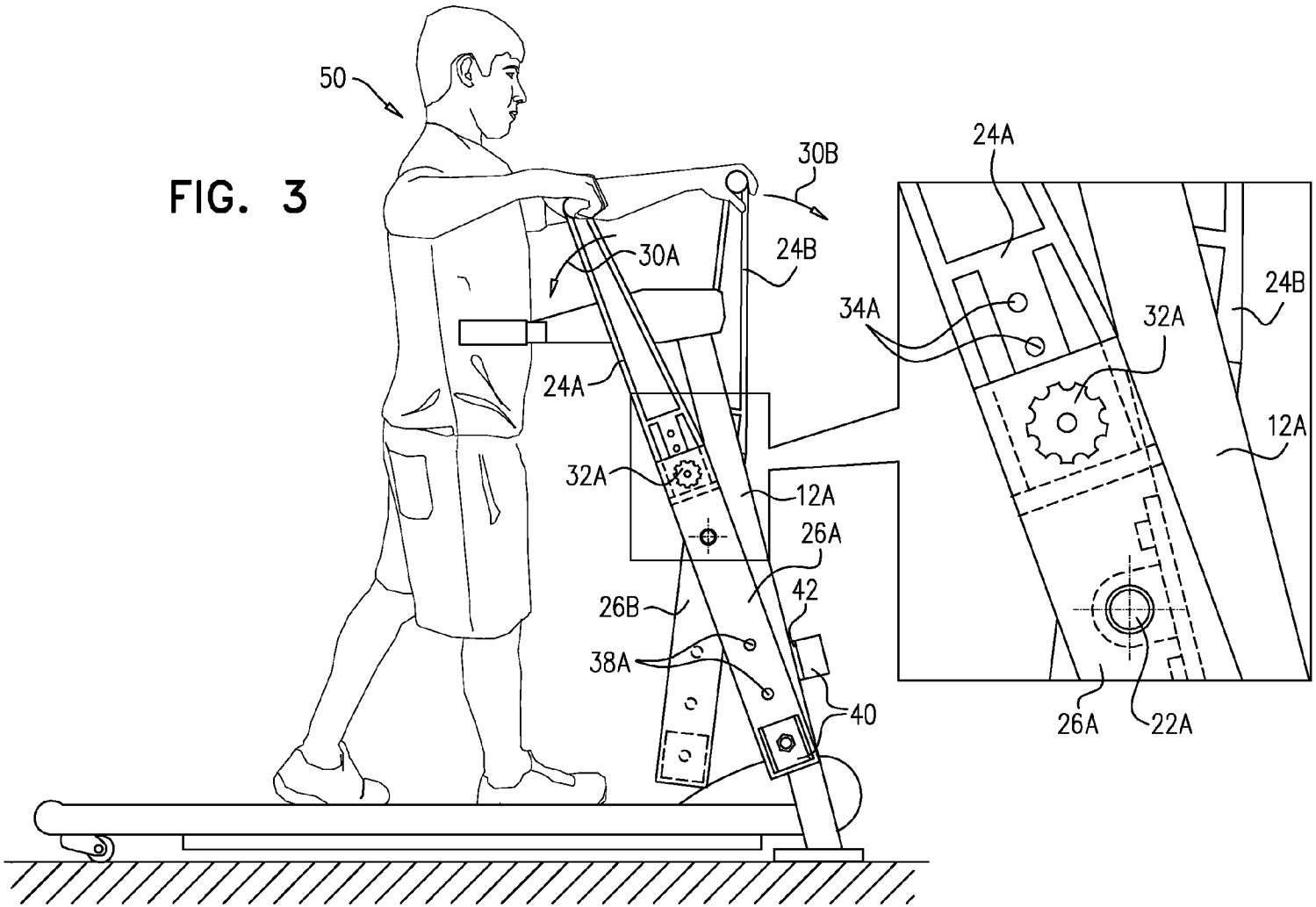
FIG. 3 is a schematic side view diagram illustrating a Nordic walking exercise achievable by an embodiment of the combined exercise apparatus of the invention.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DISCLOSURE OF EMBODIMENTS

Illustrative embodiments of the invention are described below. In the interest of clarity, not all features of actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

In accordance with some embodiments of the present invention, reference is now made to FIG. 1 to 5, showing treadmill assembly 10, furnished with add-on members 20A and 20B, configured for a Nordic walking exercise as well as forceful strength training and/or weight lifting exercise. Treadmill assembly 10 is typically a standard treadmill, comprising vertical struts 12A and 12B, supporting the upper portion 14, optionally furnished with screen 16 and handles 18.

Add-on members 20A and 20B, configured to allow a combined Nordic walking as well as forceful strength training and/or weight lifting exercise, are mounted onto support tabs 22A and 22B, which are affixed to vertical struts 12A and 12B of treadmill assembly 10. Support tabs 22A and 22B are optionally affixed to vertical struts 12A and 12B by a means of bolts, screws, rivets or any other type of fasteners. Tabs 22A and 22B are preferably affixed to vertical struts 12A and 12B by a means of frictional fasteners (not shown), circumstantially adjoining struts 12A and 12B and reversibly tightened thereon, thereby allowing controllably releasing the frictional adjoining to struts 12A and 12B and adjusting the vertical position of tabs 22A and 22B on struts 12A and 12B.

Tabs 22A and 22B are typically furnished with bearings, sustaining rotation of add-on members 20A and 20B relatively to struts 12A and 12B. Members 20A and 20B typically include pivots 28A and 28B, respectively, inserted into tabs 22A and 22B so as sustaining rotation of add-on members 20A and 20B relatively to struts 12A and 12B. In some embodiments, however, tabs 22A and 22B include pivots (not shown), similar to pivots 24A and 24B, whereas members 20A and 20B, mutatis mutandis, include apertures configured to receive aforesaid pivots so as sustaining rotation of members 20A and 20B relatively to struts 12A and 12B.

It is noted that the rotation of member 20A relatively to strut 12A is performable independently to the rotation of member 20B relatively to strut 12B. The independent rotation of member 20A and member 20B allowing a Nordic walk type for person 50 undertaking exercise, depicted in FIG. 3, wherein member 20A is rotated in the direction indicated by arrow 30A, whereas member 20B concomitantly rotated the opposite direction indicated by arrow 30B, and vice versa in turn.

Members 20A and 20B preferably include two telescopic subparts, namely driven subparts 24A and 24B as well as weight loading subparts 26A and 26B. Driven subpart 24A is translatable relatively to weight loading subparts 26A whereas driven subpart 24B is independently translatable relatively to 26B; thereby allowing controllably adjusting the lengths of members 20A and 20B in an independent manner. Driven subparts 24A and 24B are affixable in respect to weight loading subparts 26A and 26B by the means of knobs 32A and 32B, respectively. Driven subparts 24A and 24B or optionally weight loading subparts 26A and 26B include an array of apertures 34A and 34B, into which knobs 32A and 32B are insertable in order to affix driven subparts 24A and 24B in a particular position relatively to weight loading subparts 26A and 26B, respectively, thereby allowing independently and controllably determining the lengths of members 20A and 20B.

Driven subparts 24A and 24B comprise gripping handles 36A and 36B, respectively, configured for gripping by the hands in order to perform the combined exercise. Weight loading subparts 26A and 26B include an array of pins 38A and 38B, respectively, employed for threading weights 40 thereon. Weights 40 include an aperture therein, respectively matching pins 38A and 38B, on weight loading subparts 26A and 26B include. Pins 38A and 38B optionally include fasteners (not shown) configured for securing weights 40 thereon and preventing release of weights 40 from pins 38A and 38B.

It is noted that weights 40 preferably embody an elongated rectangular shape, as opposed to the standard discoid shape known in the art, configured to prevent inadvertent collision of weights 40 with knees and lower limbs of person 50 undertaking exercise on treadmill assembly 10. It is further emphasized that each of add-on members 20A and 20B, on treadmill assembly 10 can be loaded with different strain, by manipulating the number weights 40 threaded onto pins 38A and 38B of weight loading subparts 26A and 26B of each of add-on member 20A or 20B. Consequently the strain applied to each hand, whether right or left, can be customizeably set by loading a desired number weights 40 onto each loading subpart 26A or 26B of add-on members 20A and 20B.

Treadmill assembly 10 preferably includes panel 42, extending between struts 12A and 12B. Panel 42 comprises a plurality of pins, similar to pins 38A and 38B, used to accommodate surplus weights 40 which currently are not loaded onto weight loading subpart 26A and 26B of add-on members 20A and 20B, respectively.

In some preferred embodiments treadmill assembly 10 comprises a rod (not shown) interlocking between handles 36A and 36B of driven subparts 24A and 24B; thereby unifying the movements of add-on member 20A or 20B. In such a configuration person 50 undertaking exercise on treadmill assembly 10 may engage in forceful strength training, depicted in FIGS. 4A and 4B, involving simultaneous movement of handles 36A and 36B in essentially horizontal orientation. During forceful strength training, person 50 simultaneously pulls both handles 36A and 36B on driven subparts 24A and 24B of add-on members 20A and 20B, in direction of arrow 44A towards himself/herself and then in turn simultaneously pushes both handles 36A and 36B on driven subparts 24A and 24B of add-on members 20A and 20B, in direction of arrow 44B away from himself/herself. Typically during forceful strength training person 50 applies essentially the force of the torso as well as upper limbs to swing add-on members 20A and 20B back and forth.

Figure 4B:
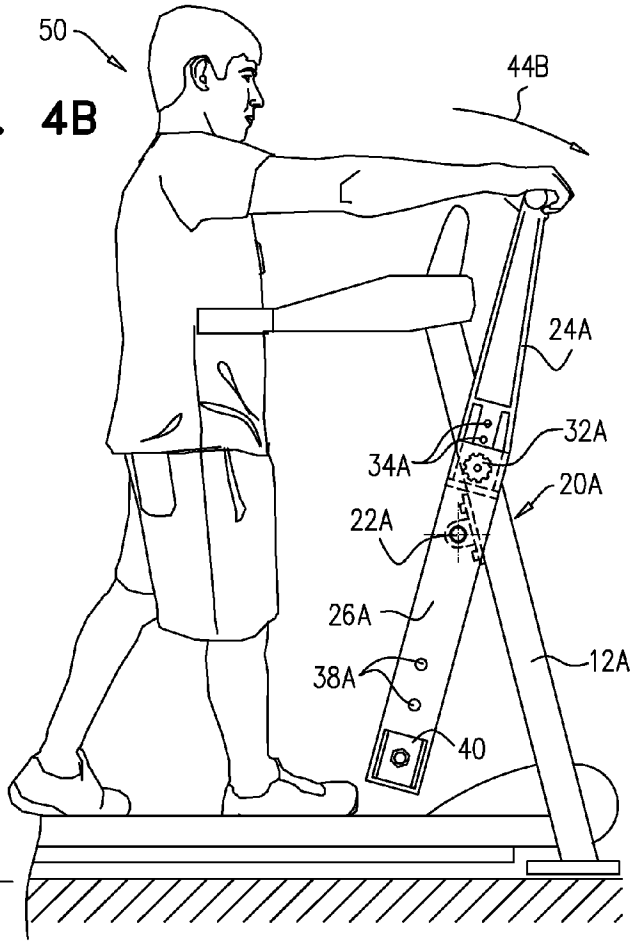
FIGS. 4A and 4B are schematic side view diagrams illustrating a strength training exercise achievable by an embodiment of the combined exercise apparatus of the invention.
Figure 4A:
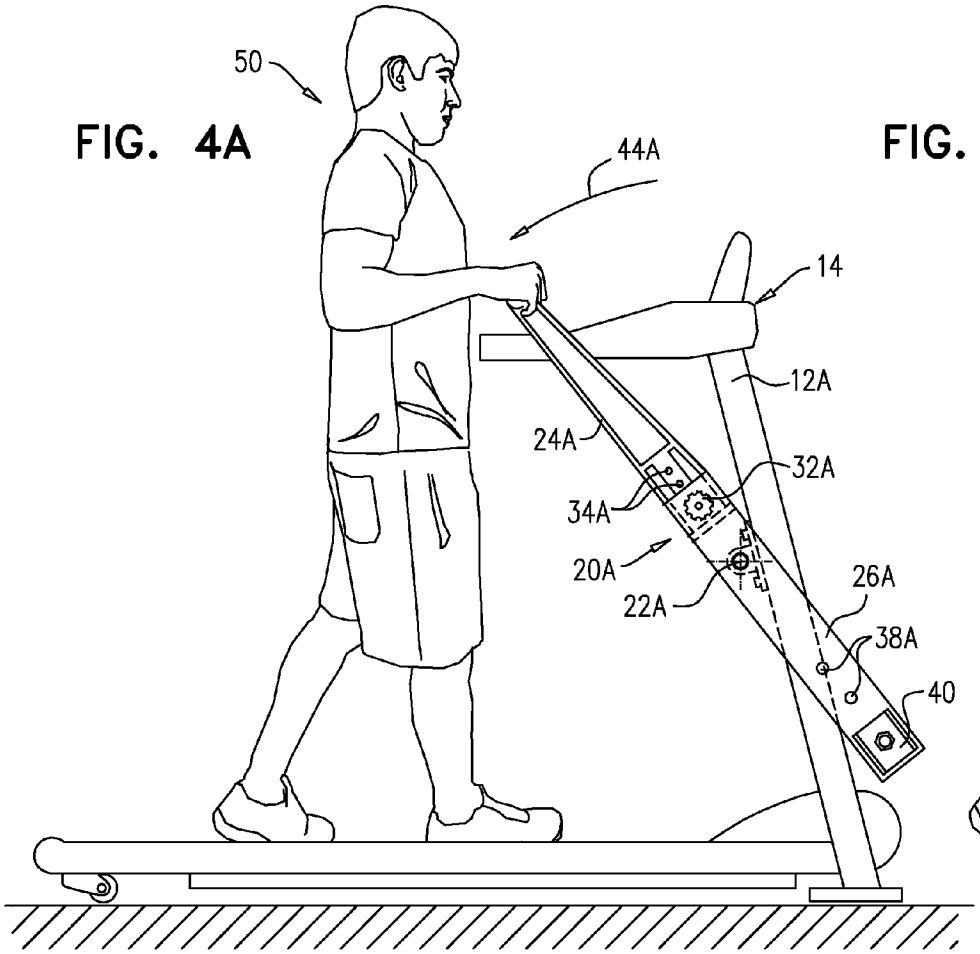

It should be noted that forceful strength training, as referred to herein, depicted in FIGS. 4A and 4B, entailing simultaneously pulling both handles 36A and 36B in direction of arrow 44A and then in turn simultaneously pushing both handles 36A and 36B in direction of arrow 44B does not require aforesaid rod (not shown) which interlocks handles 36A and 36B but rather the simultaneous movement of add-on members 20A and 20B, can be synchronized by person 50. If aforesaid rod (not shown) which interlocks handles 36A and 36B is not implemented but rather the person 50 synchronizes simultaneous movement of add-on members 20A and 20B, the strain applied to each hand, whether right or left, can be customizeably set by loading a desired number weights 40 onto each loading subpart 26A or 26B of add-on members 20A and 20B.

Figure 5:
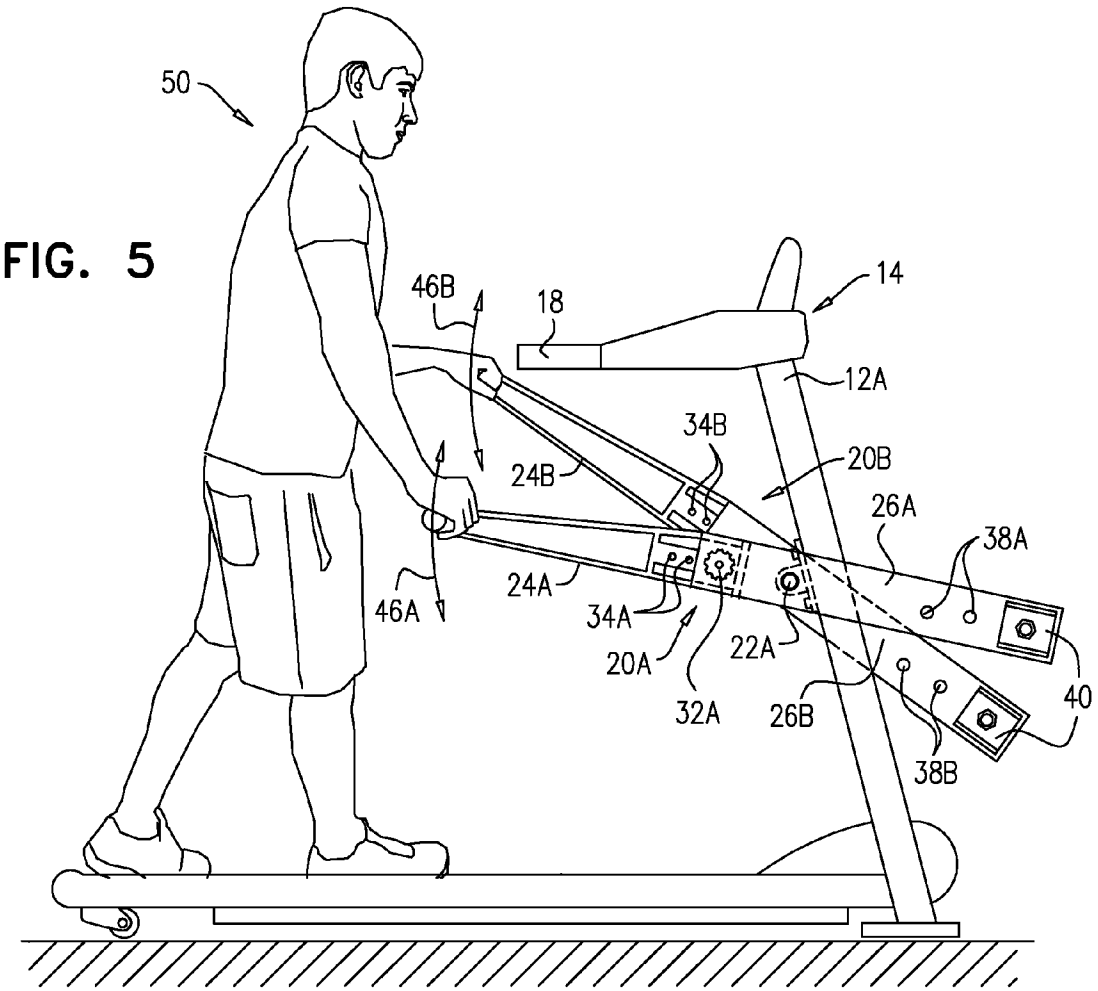
FIG. 5 is schematic side view diagram illustrating a yet another weight lifting exercise achievable by an embodiment of the combined exercise apparatus of the invention.

Furthermore and contradistinctively to the prior art, in some preferred embodiments treadmill assembly 10 is configured for weight lifting exercise, depicted in FIG. 5. Weight lifting exercise, as referred to herein, entails swinging add-on members 20A and 20B into an essentially horizontal position, as shown in FIG. 5, and performing forceful pushing downwards and forceful restraining the lifting up of handles 36A and 36B, in essentially vertical orientation, in the direction of arrows 46A and 46B on driven subparts 24A and 24B of add-on members 20A and 20B, respectively. Typically during weight lifting exercise person 50 steps somewhat backwards on treadmill assembly 10 and applying essentially the manual force of the upper limbs to counterbalance the weight of the weights 40.

It should be noted that weight lifting exercise, as referred to herein, depicted in FIG. 5, may entail simultaneously pushing both handles 36A and 36B in direction of arrows 46A and 46B then in turn simultaneously forcefully restraining the lifting up of handles 36A and 36B in direction of arrows 46A and 46B, which is optionally performed with aforesaid rod (not shown) which interlocks handles 36A and 36B or alternatively the simultaneous movement of add-on members 20A and 20B, can be synchronized by person 50. If aforesaid rod (not shown) which interlocks handles 36A and 36B is not implemented but rather the person 50 synchronizes simultaneous movement of add-on members 20A and 20B, the strain applied to each hand, whether right or left, can be customizeably set by loading a desired number weights 40 onto each loading subpart 26A or 26B of add-on members 20A and 20B.

In some embodiments however weight lifting exercise, as referred to herein, depicted in FIG. 5, may entail simultaneously pushing handle 36A downwards in direction of arrow 46A while simultaneously forcefully restraining the lifting up of handle 36B in direction of arrow 46B. In such a case the add-on members 20A and 20B are driven by person 50 in opposite directions, which constitutes a variation of the weight lifting exercise, as referred to herein.

In some embodiments treadmill assembly 10 is provided or commercialized with the add-on members 20A and 20B as a combined exercise apparatus, shown in FIG. 1 to 5, while support tabs 22A and 22B are pre-fitted to vertical struts 12A and 12B. In such instances vertical struts 12A and 12B as well as support tabs 22A and 22B optionally include structural elements allowing affixing the latter along the former in predetermined location. It is noted, however, that in some preferred embodiments treadmill assembly 10 is a standard existing treadmill, whereas the constituents of add-on members 20A and 20B as well as support tabs 22A and 22B provided or commercialized as a kit-of-parts, configured for assembling a combined exercise apparatus onto standard existing treadmill.

BIBLIOGRAPHICAL CITATION LIST OF PATENT LITERATURE

U.S. Pat. Nos. 5,000,440, 5,171,196, 6,544,147, 5,632,708, 8,007,409, 8,241,187, 5,951,449 and 5,110,117

US patent application Ser. Nos. 2008287267 and 2009075784

European patents Ser. No. 1312395 and 0877640;

German utility model Ser. No. 202005012299

Chinese utility model Ser. No. 2511339

International patent application Pub. No. WO9938575

It will be appreciated by persons skilled in the art that the present invention is not limited by what has been particularly shown and described herein above. Rather the scope of the invention is defined by the claims which follow:

The invention claimed is:

1. A combined exercise apparatus comprises:

(a) a treadmill assembly comprising an upper portion supported by at least:
a first vertical strut and a second vertical strut;

(b) a first support tab and a second support tab, said support tabs comprising:
(I) a fastener rendering said support tabs affixable to said vertical struts;
(II) at least one structural element configured to sustain rotation relative to said support tabs;
wherein said fastener of said first support tab is affixable to said first vertical strut whereas said fastener of said second support tab is affixable to said second vertical strut;

(c) a first add-on member and a second add-on member, said add-on members comprising:
(I) a driven subpart, extending essentially towards a person undertaking exercise on said apparatus;
(II) a weight loading subpart, extending essentially away from said person undertaking exercise on said apparatus;
(III) a gripping handle attached to said driven subpart;
(IV) a respective structural element matching said structural element of said support tabs and configured to sustain rotation relative thereto;
(V) at least one dedicated structural element, configured for affixing at least one weight to said weight loading subpart;

(d) wherein said respective structural element of said first add-on member is rotatably connectable to said first support tab whereas said respective structural element of said second add-on member is rotatably connectable to said second support tab;

(e) at least one weight affixable to said at least one dedicated structural element on said weight loading subparts;

said combined exercise apparatus is capable of assuming at least two different configurations wherein:
(I) in first configuration said add-on members are oriented essentially vertically, thereby providing for a Nordic walk exercise, and
(II) in second configuration said add-on members are oriented essentially horizontally, thereby providing for a weight lifting exercise;

said combined exercise apparatus is characterized by that said weight loading subpart of said first add-on member is loadable with a different weight than said weight loading subpart of said second add-on member.

2. The apparatus as net forth in claim 1, wherein said first add-on member is rotatable independently relative to said second add-on member.

3. The apparatus as set forth in claim 1, wherein said driven subparts are disposed and movable concentrically relative to said weight loading subparts of said add-on members.

4. The apparatus, as set forth in claim 3, further comprises a mechanism configured for affixing said driven subparts to said weight loading subparts, thereby allowing independently and controllably adjusting the lengths of said add-on members.

5. The apparatus as set forth in claim 1, wherein said support tabs are affixed to said vertical struts by a means of frictional joining, thereby allowing controllably adjusting a vertical position of said tabs relative to said struts.

6. The apparatus as set forth in claim 1, wherein said weights embody an elongated rectangular shape, configured to prevent inadvertent collision of said weights with knees and lower limbs of a person undertaking exercise on said apparatus.

7. A kit-of-parts configured for assembling a combined exercise apparatus from a treadmill comprising at least a first vertical strut and a second vertical strut, said kit-of-parts comprises:

(a) a first support tab and a second support tab, said support tabs comprising:
(I) a fastener rendering said support tabs affixable to said vertical struts;
(II) at least one structural element configured to sustain rotation relative to said support tabs;
wherein said fastener of said first support tab is affixable to said first vertical strut whereas said fastener of said second support tab is affixable to said second vertical strut;

(b) a first add-on member and a second add-on member, said add-on members comprising:
(I) a driven subpart, extending essentially towards a person undertaking exercise on said apparatus;
(II) a weight loading subpart; extending essentially away from said person undertaking exercise on said apparatus;
(III) a gripping handle attached to said driven subpart;
(IV) a respective structural element matching said structural element of said support tabs and configured to sustain rotation relative thereto;
(V) at least one dedicated structural element, configured for affixing at least one weight to said weight loading subpart;
wherein said respective structural element of said first add-on member is rotatably connectable to said first support tab whereas said respective structural element of said second add-on member is rotatably connectable to said second support tab;

said combined exercise apparatus is capable of assuming at least two different configurations wherein:

(I) in first configuration said add-on members are oriented essentially vertically, thereby providing for a Nordic walk exercise, and (II) in second configuration said add-on members are oriented essentially horizontally, thereby providing for a weight lifting exercise;

said combined exercise apparatus is characterized by that said weight loading subpart of said first add-on member is loadable with a different weight than said weight loading subpart of said second add-on member.

8. The kit-of-parts as set forth in claim 7, wherein said first add-on member is rotatable independently to said second add-on member.

9. The kit-of-parts as set forth in claim 7, wherein said driven subparts are disposed and movable concentrically relative to said weight loading subparts of said add-on members.

10. The kit-of-parts, as set forth in claim 9, further comprises a mechanism configured for affixing said driven subparts to said weight loading subparts, thereby allowing independently and controllably adjusting the lengths of said add-on members.

11. The kit-of-parts as set forth in claim 7, wherein said support tabs are affixable to said vertical struts by a means of frictional joining, thereby allowing controllably adjusting a vertical position of said tabs relative to said struts.

12. The kit-of-parts as set forth in claim 7, further comprises at least one weight affixable to said at least one dedicated structural element on said weight loading subparts.

13. The kit-of-parts as set forth in claim 7, wherein said weights embody an elongated rectangular shape, configured to prevent inadvertent collision of said weights with knees and lower limbs of a person undertaking exercise on said apparatus.

14. A method of assembling a combined exercise apparatus, said method comprises:

(a) providing a treadmill comprising at least a first vertical strut and a second vertical strut;

(b) providing a kit-of-parts comprising:

(I) a first support tab and a second support tab; said support tabs comprising:

(i) a fastener rendering said support tabs affixable to said vertical struts;

(ii) at least one structural element configured to sustain rotation relative to said support tabs;

(II) a first add-on member and a second add-on member, said add-on members comprising:

(i) a driven subpart, extending essentially towards a person undertaking exercise on said apparatus;

(ii) a weight loading subpart, extending essentially away from said person undertaking exercise on said apparatus;

(iii) a gripping handle attached to said driven subpart;

(iv) a respective structural element matching said structural element of said support tabs and configured to sustain rotation relative thereto;

(v) at least one dedicated structural element, configured for affixing at least one weight to said weight loading subpart;

(c) affixing said fastener of said first support tab to said first vertical strut said and affixing fastener of said second support tab to said second vertical strut;

(d) rotatably connecting said respective structural element of said first add-on member to said first support tab and rotatably connecting said respective structural element of said second add-on member to said second support tab;

wherein said combined exercise apparatus is capable of assuming at least two different configurations wherein:

(I) in first configuration said add-on members are oriented essentially vertically, thereby providing for a Nordic walk exercise, and (II) in second configuration said add-on members are oriented essentially horizontally, thereby providing for a weight lifting exercise;

said combined exercise apparatus is characterized by that said weight loading subpart of said first add-on member is loadable with a different weight than said weight loading subpart of said second add-on member.

15. The method as set forth in claim 14, wherein said first add-on member is rotatable independently to said second add-on member.

16. The method as set forth in claim 14, wherein said driven subparts are disposed and movable concentrically relative to said weight loading subparts of said add-on members.

17. The method, as set forth in claim 14, wherein said add-on members comprise a mechanism for affixing said driven subparts to said weight loading subparts, further comprises independently and controllably adjusting the lengths of said add-on members.

18. The method as set forth in claim 17, wherein said support tabs are affixable to said vertical struts by a means of frictional joining, further comprises controllably adjusting a vertical position of said tabs relative to said struts.

* * * * *